US010377168B2

(12) United States Patent
Lin

(10) Patent No.: US 10,377,168 B2
(45) Date of Patent: Aug. 13, 2019

(54) ELECTRIC PENCIL SHARPENER

(71) Applicant: Xiasen Lin, Taizhou (CN)

(72) Inventor: Xiasen Lin, Taizhou (CN)

(73) Assignee: SUNWOOD HOLDING GROUP CO., LTD., Taizhou (CN)

( * ) Notice: Subject to any disclaimer, the term of this patent is extended or adjusted under 35 U.S.C. 154(b) by 244 days.

(21) Appl. No.: 15/666,592

(22) Filed: Aug. 2, 2017

(65) Prior Publication Data

US 2019/0001738 A1 Jan. 3, 2019

(30) Foreign Application Priority Data

Jun. 29, 2017 (CN) ..... 2017 1 0510830

(51) Int. Cl.
*B43L 23/02* (2006.01)

(52) U.S. Cl.
CPC ..... *B43L 23/02* (2013.01)

(58) Field of Classification Search
CPC ..... B43L 23/00; B43L 23/004; B43L 23/008; B43L 23/02; B43L 23/06; B43L 23/08; B43L 23/085; B43L 23/04
See application file for complete search history.

(56) References Cited

U.S. PATENT DOCUMENTS 3,650,308 A * 3/1972 Hori ..... B43L 23/02 144/28.5
3,777,791 A * 12/1973 Uchida ..... B43L 23/02 144/28.5
6,886,614 B2 * 5/2005 Ricono ..... B43L 23/02 144/28.11
7,934,319 B2 * 5/2011 Peterson ..... B43L 23/008 30/346
9,669,651 B2 * 6/2017 Zhong ..... B43L 23/02

* cited by examiner

*Primary Examiner* — Matthew Katcoff
(74) *Attorney, Agent, or Firm* — Minder Law Group; Willy H. Wong

(57) ABSTRACT

The present invention provides an electric pencil sharpener, and pertains to the field of mechanical technology. It resolves the issue that existing electric pencil sharpeners are unable to be switched off automatically when emptying the shavings debris. The present electric pencil sharpener comprises a housing, and a power receptacle is fixed to the housing. The electric pencil sharpener also comprises a base. The housing is placed on the base, while a power connector is fixed to the base. The power connector is electrically connected to the power receptacle, and a locating structure is arranged between the housing and the base to circumferentially secure the housing and the base. It has the advantages that the power is cut off automatically while the normal service performance is ensured.

14 Claims, 12 Drawing Sheets

ELECTRIC PENCIL SHARPENER

RELATED APPLICATIONS

This application claims benefit to Chinese Patent Application No. CN201710510830.2, filed Jun. 29, 2017.

The above applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

BACKGROUND OF THE INVENTION

Field of Invention

The present invention pertains to the field of mechanical technology, and more particularly to an electric pencil sharpener.

Related Art

An electric pencil sharpener is a kind of common office stationery used in offices or in study. As the pace of life continues to accelerate nowadays, people are more and more pursuing convenience and high efficiency. The electric pencil sharpeners are widely used since they can sharpen pencils automatically. At present, there are various electric pencil sharpeners in the marketplace. However, their common structure generally comprises a housing, and a sharpener core, consisting of a pencil bracket, a sharpening component and a motor to control the sharpening component, is arranged inside the housing. Based on the power supply mode of the motor, electric pencil sharpeners can be classified into two types: the battery powered ones and the external power source connected ones. It is more convenient to use an electric pencil sharpener powered by batteries, but the volume is bulky. However, although the volume is compact for an electric pencil sharpener connected to external power source, users need to connect it to the power source when using it. Therefore, people often select one based on their own requirements.

As for electric pencil sharpeners connected to external power source, in general, a power receptacle is fixed inside the housing of the electric pencil sharpener, and then a power connector hole is correspondingly arranged on the side of the housing. When sharpening pencils, the connector of the power source is plugged into the power connector hole and connects to the power receptacle, so as to power the motor to drive the sharpening component to start sharpening the pencil. There is a disadvantage in this mode of connecting the external power source. After finishing sharpening the pencil, the shavings debris needs to be emptied and the housing is required to be removed to empty the shavings debris. In this situation, the sharpening component is directly exposed, and users often forget to unplug the power connector after finishing sharpening the pencil. Hence, the motor is always powered on, and the user may get cut and hurt. At present, in other fields such as electrical kettles, a structure capable of automatically power down is set up. The electrical kettle is mainly manufactured with a split module structure, comprising a kettle body and a base. The kettle body is placed on the base and electrically connected to boil water. When the kettle body is removed from the base, the power is automatically switched off. However, due to the differences in fields and actual work conditions, if such a structure is directly applied to the electric pencil sharpener to achieve the function of automatic power down, the normal service performance of the electric pencil sharpener will be definitely affected. This is mainly because the electric kettle is stationary when boiling water, while the electric pencil sharpener vibrates during operation. The vibration will strongly impact the electrical connection, and hence the normal sharpening performance cannot be ensured. Therefore, the split module structure are usually not selected for the electric pencil sharpeners to achieve the function of automatic power down.

SUMMARY OF THE INVENTION

One objective of one embodiment of the present invention is to avoid the issues stated above in the prior art, and to provide an electric pencil sharpener. One technical issue to be resolved is how to ensure the normal service performance while achieving the function of automatic power down.

One objective of one embodiment of the present invention can be achieved by the following technical proposal:

An electric pencil sharpener comprises a housing, and a power receptacle is fixed to the housing. It is characterized in that:

The electric pencil sharpener also comprises a base. The housing is placed on the base, while a power connector is fixed to the base. The power connector is electrically connected to the power receptacle, and a locating structure is arranged between the housing and the base to circumferentially secure the housing and the base.

When a pencil needs to be sharpened, the housing is placed on the base, and it is ensured that the power connector is electrically connected to the power receptacle, making the electric power from the power source transmitted to the sharpener core through the power connector. Hence the sharpener core can sharpen the pencil. When sharpening is completed and the shavings debris needs to be emptied, the housing may be directly pulled off the base, and then the housing can be disassembled to empty the shavings debris. There is no need to switch off the power, mainly because the power connector automatically detaches from the power receptacle after the housing is pulled off the base. In addition, after the electrical connection is disconnected between the power connector and the power receptacle, even if the power source is not unplugged, the power source can no longer transmit the electric power to the sharpener core, so as to achieve the function of automatic power down when emptying the shavings debris.

Meanwhile, since the sharpener core is driven by the motor to sharpen pencils, it is prone to vibrating the electric pencil sharpener when sharpening pencils. In addition, the housing is placed on the base, and the base is seated on a flat surface without securing structures. Hence, when sharpening pencils, the vibration will arise first in the housing in the radial and circumferential directions relative to the base, and then transmit to the base to make the base vibrate together. The radial and circumferential shifts of the housing on the base are equivalent to a torsional force applied to the housing. In addition, the power connector is electrically connected to the power receptacle, even though the power connector is fixed onto the housing, since it takes some time lag for the housing and the base to produce a synchronous vibration due to the transmission of the vibration, thus, the torsional force will directly apply to the power connector.

Hence, the power connector may be misaligned or bended, or the reaction force will apply to the power receptacle inside the housing so that the positions of the power receptacle will shift, and hence the connection stability between the power connector and the power receptacle will be affected. As a result, after a long time of use, an accidental power down would arise because of the unstable connection between the power connector and the power receptacle. In view of this situation, in the present electric pencil sharpener a locating structure is provided to circumferentially secure the housing to the base. The locating structure is utilized to eliminate the time lag which results in the synchronous vibration between the housing and the base, making the housing drive the base to rotate together at the moment when the vibration arises. Hence, the torsional force resulting from the radial and circumferential shifts of the housing on the base is eliminated, the connection stability between the power connector and the power receptacle is improved, and the normal service performance of the electric pencil sharpener is ensured.

In one embodiment of the electric pencil sharpener, the locating structure comprises a locating bump protruding from the rim of the upper surface of the base, as well as a locating recess arranged on the bottom of the housing. The locating bump is embedded into the locating recess.

In one embodiment of the present electric pencil sharpener, the locating structure is formed by arranging a locating bump on the base, arranging a locating recess on the housing, and embedding the locating bump into the locating recess, so as to prevent the housing from shifting in the radial and circumferential directions relative to the base and producing synchronous vibration between the housing and the base. Hence, the stability of the power connector's plugging into the power connector hole is improved. Not only the automatic power down during shavings discharge is implemented, but accidental power outages, caused by the implementation of automatic power down, during pencil sharpening are also prevented, and the normal sharpening operation of the electric pencil sharpener is ensured.

In one embodiment of the electric pencil sharpener, the housing comprises a pan and a lower shell. There is a mouth on the lower end of the lower shell. The pan is connected to the lower end of the lower shell and seals the mouth of the lower shell. The sharpener core is fixed to the pan. The locating recesses comprise a first recess arranged on the bottom of the pan, as well as a second recess arranged on the bottom of the lower shell. The first recess is aligned to the second recess, and the locating bump is embedded into both the first recess and the second recess.

The locating recesses comprise the first recess and the second recess. The first recess is located on the pan, and the second recess is located on the lower shell. The pan is directly fixed to the sharpener core and connected to the mouth of the lower shell. The vibration of the sharpener core first reflects on the pan, and then transmits to the lower shell through the pan. Therefore, when the locating bump is embedded into the first recess to circumferentially secure the pan to the base, the base can vibrate synchronously with the pan. At the same time, the locating bump is also embedded into the lower shell, so the base, the pan and the lower shell all vibrate synchronously, preventing the whole body of the housing from shifting in the radial and circumferential direction relative to the base. While the function of automatic power down when emptying the shavings debris is achieved by the arrangement of the base, the impact from the vibration of the sharpener core to the power connector is greatly weakened, and the normal service performance of the electric pencil sharpener is ensured.

In one embodiment of the electric pencil sharpener, the lower shell comprises a left pod and a right pod both in an arc plate shape. The left pod and the right pod are mutually fixed through fasteners. There is an annular retainer on the inner side of the lower end of the lower shell, and there is an annular flange on the outer rim of the pan. The lower end face of the annular flange abuts on the upper end face of the annular retainer.

In one embodiment of the assembly process, the sharpener core is fixed on the pan, the left pod and the right pod enclose the outside of the sharpener core, and then fasteners are used to connect the left pod to the right pod. After the left pod and the right pod are connected to form the lower shell, an annular retainer is formed inside the lower end of the lower shell, and the annular flange on the pan exactly abuts on the annular retainer. Hence the pan is connected to the lower shell. Such a connection achieves the staged transmission of the sharpener core vibration. Combined with the locating structure formed by the locating bump and the locating recess, it allows the locating structure to eliminate the vibration forces transmitted to the housing when the sharpener core is vibrating, and resolves the technical difficulty, accidental power down, which the automatic power down function is facing when emptying the shavings debris.

In one embodiment of the electric pencil sharpener, the upper surface of the locating bump is a convex cambered surface.

The upper surface of the locating bump is designed as a convex cambered surface. The convex cambered surface can guide the locating bump embedded into the locating bump. When the housing is placed on the base, even if the locating bump is not exactly aligned with the locating recess, under the housing's own gravity, the locating recess will slide along the upper surface of the locating bump so that the locating bump is guided into the locating recess.

In one embodiment of the electric pencil sharpener, as an alternative technical proposal, the locating structure comprises a connecting cavity arranged at the bottom center of the housing, as well as a mating part protruding from the top center of the base. The cross section of the mating part is not round. The shape of the connecting cavity is the same as that of the mating part, and the mating part is embedded into the connecting cavity.

Using a locating structure, which consists of a non-circular mating part and a connecting cavity in the same shape as the mating part, can also prevent the housing from shifting in the radial and circumferential directions relative to the base due to vibrations, and achieve the synchronous vibration between the housing and the base. Therefore, this resolves the issue of poor connection stability between the power connector and the power receptacle resulting from achieving the automatic power down function when emptying the shavings debris.

In one embodiment of the electric pencil sharpener, a clamping block is fixed inside the housing, and a clamping slot is set up downward from the upper end of the clamping block. A power connector hole is arranged on the bottom of the housing, and the clamping slot is aligned to the power connector hole. The power receptacle is located inside the clamping slot. There is a protruding stopper on the inner wall of the housing, and the stopper abuts on the upper end of the power receptacle.

The power receptacle is clamped in the clamping slot of the clamping block. When the power connector passes upward through the power connector hole and plugs into the power receptacle, the power receptacle is subject to an upward force. In order to prevent the force from pushing the power receptacle out of the clamping slot, a protruding stopper is arranged on the inner wall of the housing. The stopper abuts on the upper end of the power receptacle to block the power receptacle, making the power receptacle confined within the clamping slot. Hence, the power receptacle is firmly secured. This can improve the connection reliability between the power connector and the power receptacle, and avoids the loading problem of the power receptacle resulting from implementing the function of automatic power down when emptying the shavings debris, which is caused by setting the power connector hole to the bottom of the housing. This ensures that the position of the power receptacle will not shift, hence improves the stability of the connection to the power connector, and ensures the normal service performance of the electric pencil sharpener.

Although the power receptacle may be fixed by welding or glue in prior art, the welding spot or the glue joint is prone to breaking because the power receptacle is subject to the reaction force from the power connector. Therefore, the effect of the fixation is not as good as when the clamping slot and the stopper are used.

In one embodiment of the electric pencil sharpener, there is a locating column and a boss inside the base. A locating hole is arranged on the bottom of the locating column, and an output hole aligned to the locating hole is arranged on the upper face of the base. The power connector has a columnar locator, and the locator is located inside the locating hole. An output lead is arranged on the locator, and the output lead passes through the output hole and connects the power receptacle. There is a bulge on the bottom of the locator. The boss has a mating hole, and the bulge is embedded into the mating hole.

The power connector is connected to the power receptacle through the output lead and achieves the electrical connection. Since the bulge is located in the bottom of the locator, after the bulge is embedded into the mating hole on the boss, the axial position of the power connector can be located in the base, and it is ensured that the power connector inside the base will not displace in the axial direction due to the radial shift of the housing. While the function of automatic power down is achieved with the utilization of the base, the stability of plugging the output lead of the power connector into the power connector hole is ensured.

In one embodiment of the electric pencil sharpener, there is a first notch on the side of the locating column, and there is a second notch on the side of the base. The power connector has a junction, and the junction is connected to the side of the locator. The input lead of the power connector is located on the side of the junction, the junction consecutively passes through the first notch, the second notch and stretches out of the side of the base, and the side wall of the junction abuts on the side walls of both the first notch and the second notch. The input lead is arranged on the side of the junction of the power connector, and the input lead is located outside the side wall of the base.

The first notch is arranged on the side of the locating column, and the second notch is arranged on the side of the base. The junction of the power connector consecutively passes through the first notch, the second notch and stretches out of the side of the base. Since both side walls of the junction abut on side walls of both the first notch and the second notch, the junction is fixed by the action of the first notch and the second notch. Hence the circumferential fixation of the power connector inside the base is achieved. Combined with the axial fixation of the power connector inside the base, as well as the synchronous vibration between the housing and the base, the stability of plugging the output lead of the power connector into the power connector hole is further improved. This also ensures the reliability of using the base to implement the function of automatic power down when emptying the shavings debris.

Compared to the prior art, in one embodiment of the present electric pencil sharpener, the power connector hole is set to the bottom of the housing, and a base with a power connector is added to mate the housing. When the housing is pulled off the base, the power connector automatically detaches from the power connector hole. By this means, the function of automatic power down when emptying the shavings debris is achieved. Meanwhile, a locating structure is arranged between the housing and the base. The position of the housing placed on the base is located by the locating structure. This prevents the housing from shifting in the radial and circumferential direction relative to the base, and achieves the synchronous vibration between the housing and the base. While the function of automatic power down during shavings discharge is achieved by the added arrangement of the base, the impact from the vibration of the sharpener core to the power connector is eliminated.

DETAILED DESCRIPTION OF THE INVENTION

Figure 1:
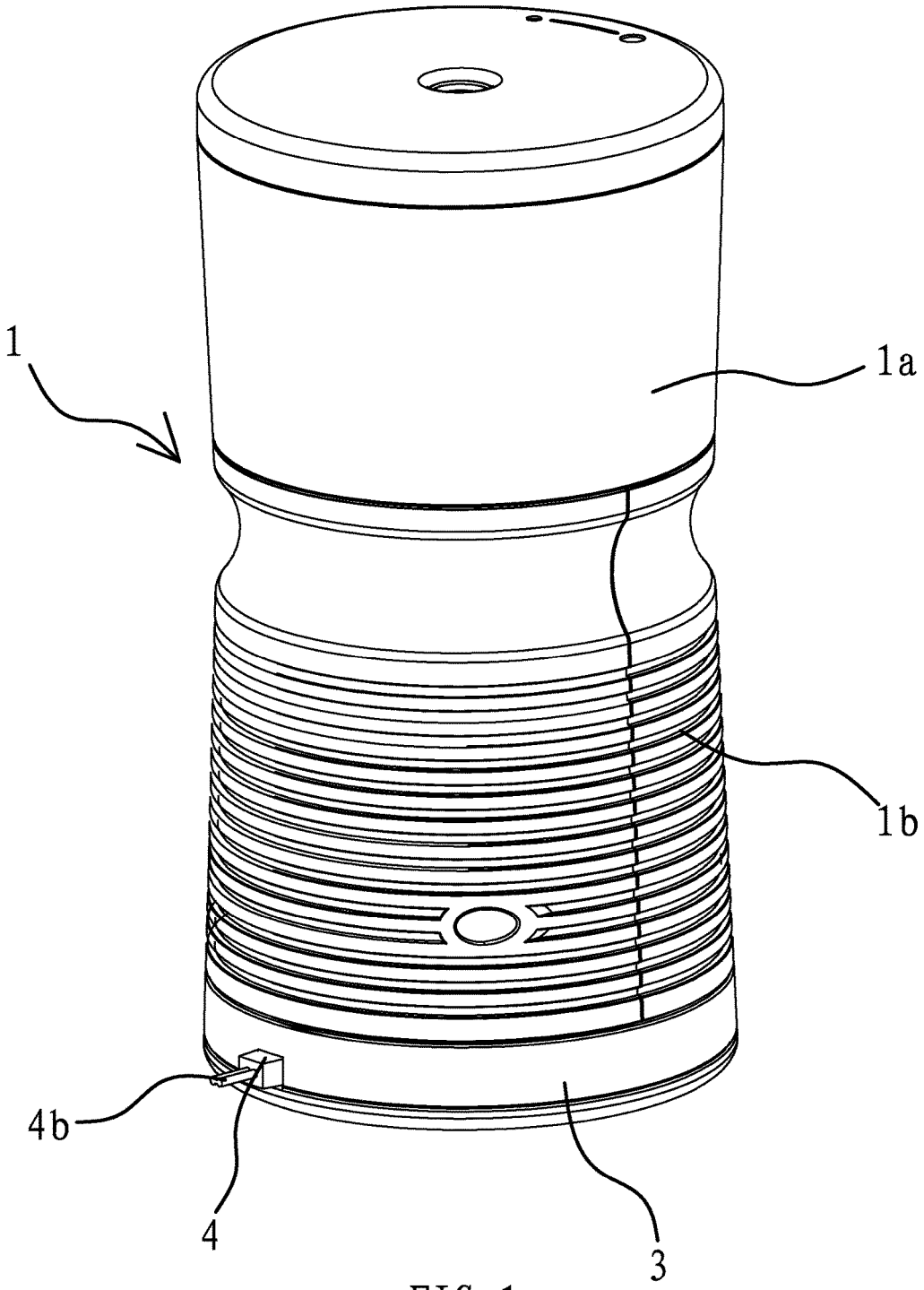
FIG. 1 is a schematic view of one embodiment of the present electric pencil sharpener.
Figure 2:
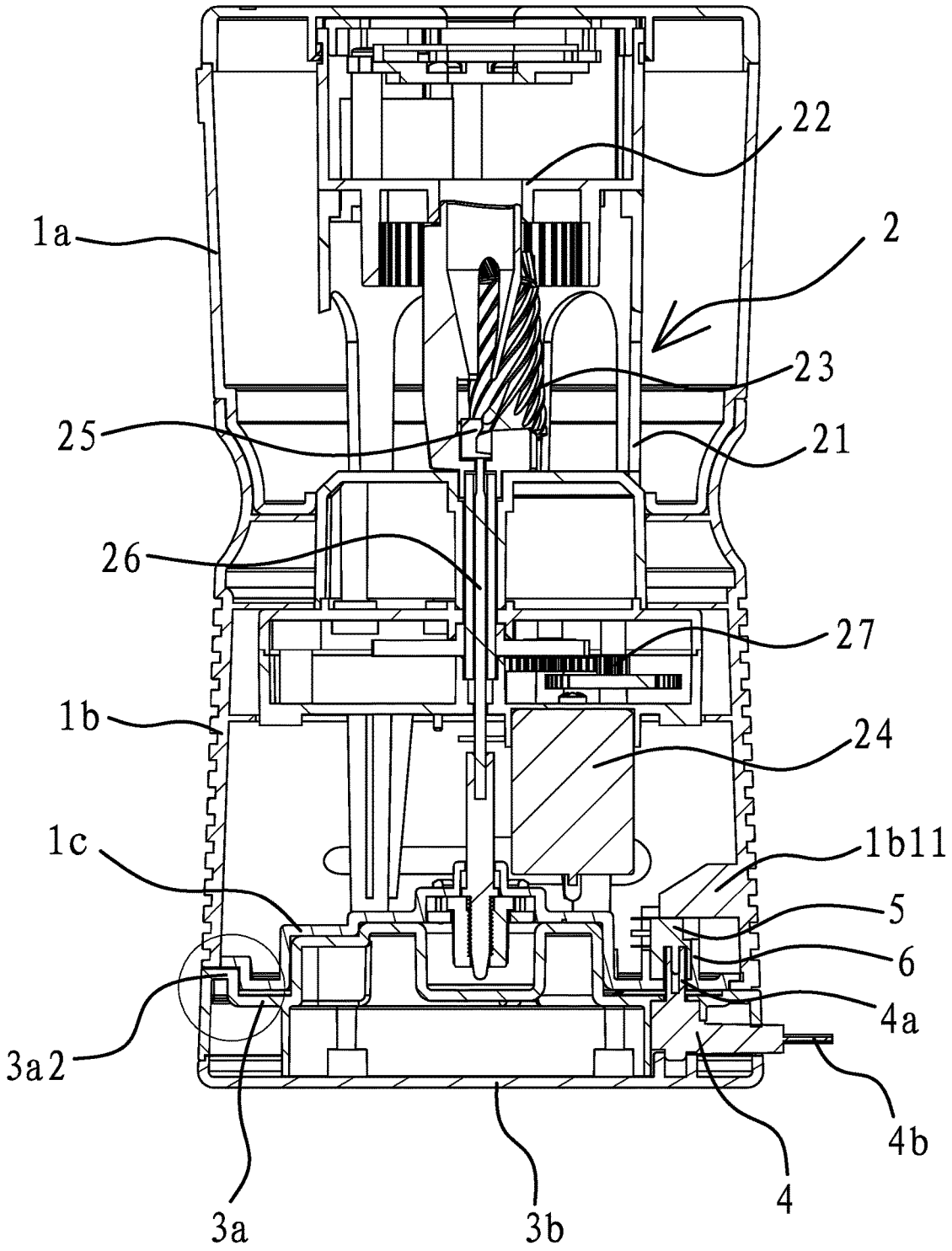
FIG. 2 is a sectional view of one embodiment of the present electric pencil sharpener.

The embodiments of this invention will be described below and the technical solutions of the invention will be further illustrated in connection with the accompanying figures. However, the present invention shall not be limited to these embodiments.

First Embodiment

As shown in FIG. 1, FIG. 2, FIG. 5, FIG. 7, and FIG. 8, one embodiment of an electric pencil sharpener comprises a housing (1) and a sharpener core (2) arranged inside the housing (1). From top to bottom, the housing (1) consecutively comprises an upper shell (1*a*), a lower shell (1*b*) and a pan (1*c*). The lower end of the lower shell (1*b*) has a mouth, and the pan (1*c*) is connected to the lower end of the lower shell (1*b*) and seals the mouth of the lower shell (1*b*). The upper part of the sharpener core (2) is located inside the upper shell (1*a*), while the lower part of the sharpener core (2) is located inside the lower shell (1*b*). On the lower end of the sharpener core (2), there are several connecting poles. The sharpener core (2) and the pan (1*c*) are fixed by fasteners which pass through the pan (1*c*) and enter the connecting poles. The sharpener core (2) includes the core chassis (21) with an upper end opening, the pencil bracket (22) set inside the core chassis (21), the sharpening component (23) on one side of the pencil bracket (22) and the motor (24). The motor (24) drives the sharpening component (23) through a gear transmission mechanism (27). There is a pencil channel within the pencil bracket (22). Within the pencil bracket (22), just below the pencil channel, there is a pencil stopper block (25) that can move up and down. A mandrel (26) is provided within the core chassis (21), along the axis. The upper end of the mandrel (26) extends into the pencil bracket (22) and rests against the lower end of the pencil stopper block (25). In this embodiment, the motor (24) is fixed at the eccentric position of the core chassis (21), on one side of the mandrel (26), the lower shell (1*b*) is made by connecting a left pod (1*b*1) to a right pod (1*b*2) both in an arc plate shape by fasteners. There is an annular flange (1*c*3) on the outer side of the pan (1*c*) and there is an annular retainer (1*b*3) on the inner side of the lower end of the lower shell (1*b*). The lower end face of the annular flange (1*c*3) abuts on the upper end face of the annular retainer (1*b*3).

Figure 3:
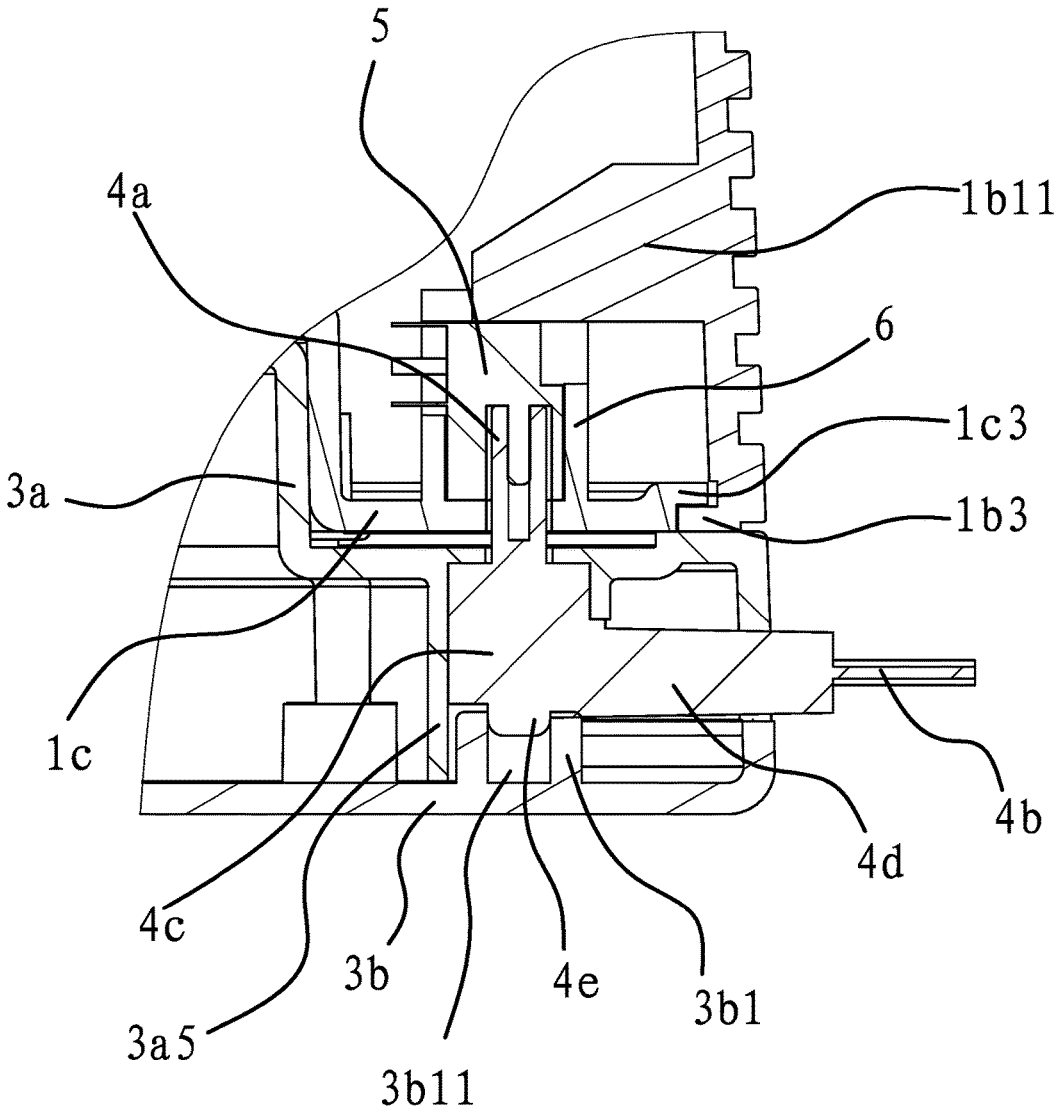
FIG. 3 is a detailed view of one embodiment of the power connector in FIG. 2.
Figure 4:
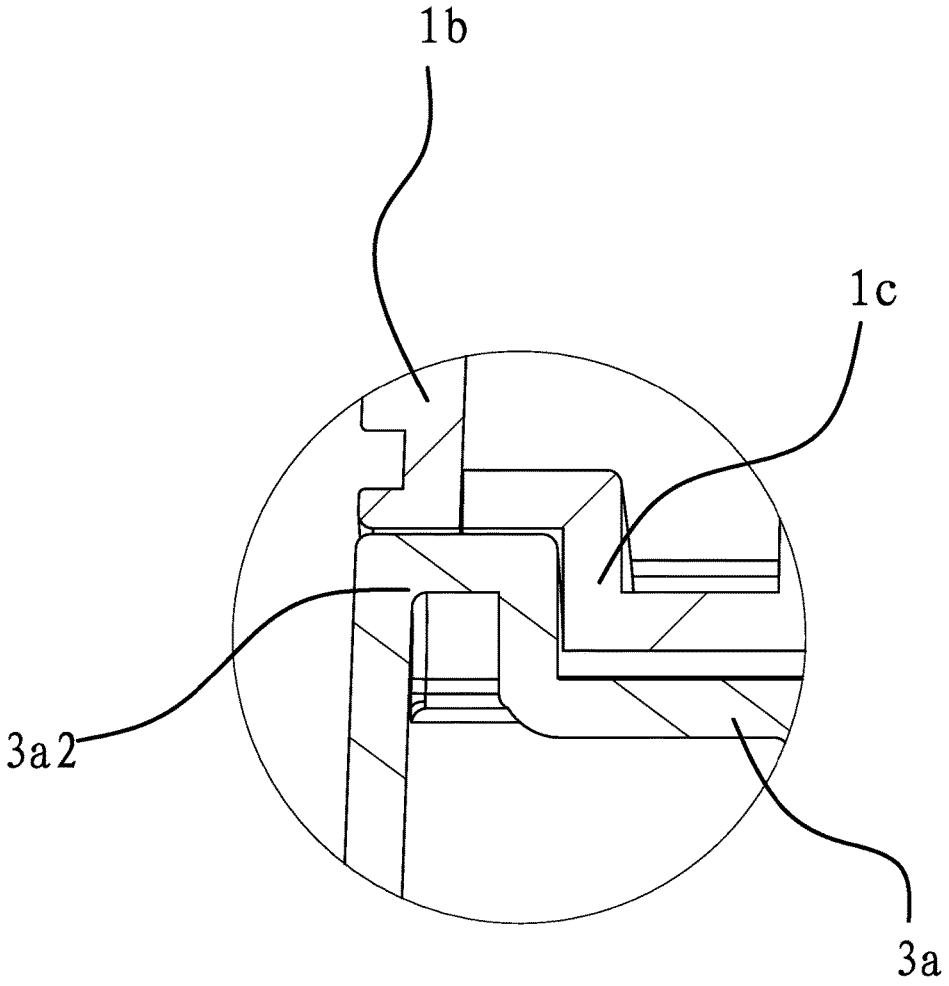
FIG. 4 is a detailed view of one embodiment of the locating bump in FIG. 2.
Figure 12:
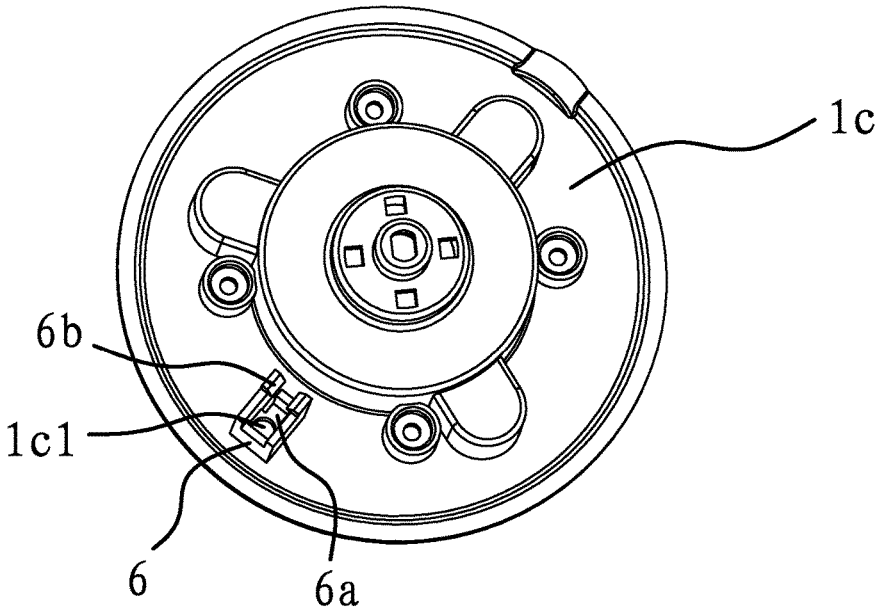
FIG. 12 is the schematic view of the pan of one embodiment of the present electric pencil sharpener.

As shown in FIG. 3 and FIG. 12, a clamping block (6) is fixed on the pan (1*c*), and a clamping slot (6*a*) is arranged on the upper end of the clamping block (6). A power receptacle (5) is clamped in the clamping slot (6*a*), and both of the clamping slot (6*a*) and the power receptacle (5) have the same shape. There is a protruding stopper (1*b*11) on the inner wall of the left pod (1*b*1), and the stopper (1*b*11) abuts on the upper end of the power receptacle (5). In this embodiment, the pan (1*c*) is made of plastic, and the clamping block (6) is integrated with the pan (1*c*). There are two buckles (6*b*) on the mouth of the upper end of the clamping slot (6*a*). The two buckles (6*b*) are block-shaped and opposite each other. The opposite sides of the two buckles (6*b*) are inclined. The inclined faces incline in opposite directions and the distance between the two inclined faces gradually increases from top to bottom. Both of the two buckles (6*b*) abut on the upper end of the power receptacle (5).

As shown in FIG. 2, FIG. 3, FIG. 8, FIG. 9, and FIG. 10, one embodiment of the electric pencil sharpener also comprises a base (3), and a power connector (4) is fixed inside the base (3). The power connector (4) comprises a input lead (4*b*) and a output lead (4*a*). A through power connector hole (1*c*1) is arranged on the base (1*c*), and the power connector hole (1*c*1) is aligned to the clamping slot (6*a*) on the clamping block (6). The output lead (4*a*) of the power connector (4) stretches out of the upper surface of the base (3), and the output lead (4*a*) of the power connector (4) passes through the power connector (4) and connects to the power receptacle (5). The input lead (4*b*) of the power connector (4) stretches out of the side of the base (3). The base (3) comprises a base plate (3*b*) and a base frame (3*a*) which is connected to the base plate (3*b*). There is a cavity on the bottom of the base frame (3*a*), and there is an annular collar (3*a*4) on the top wall of the cavity. There are several mounting posts (3*a*6) on the annular collar (3*a*4), and there are several corresponding mounting stands (3*b*2) on the base plate (3*b*). The mounting posts (3*a*6) abut on the mounting stands (3*b*2). The base plate (3*b*) and the base frame (3*a*) are connected by fasteners which pass through the mounting stands from the bottom of the base plate (3*b*) and enter into the mounting posts (3*a*6).

Figure 9:
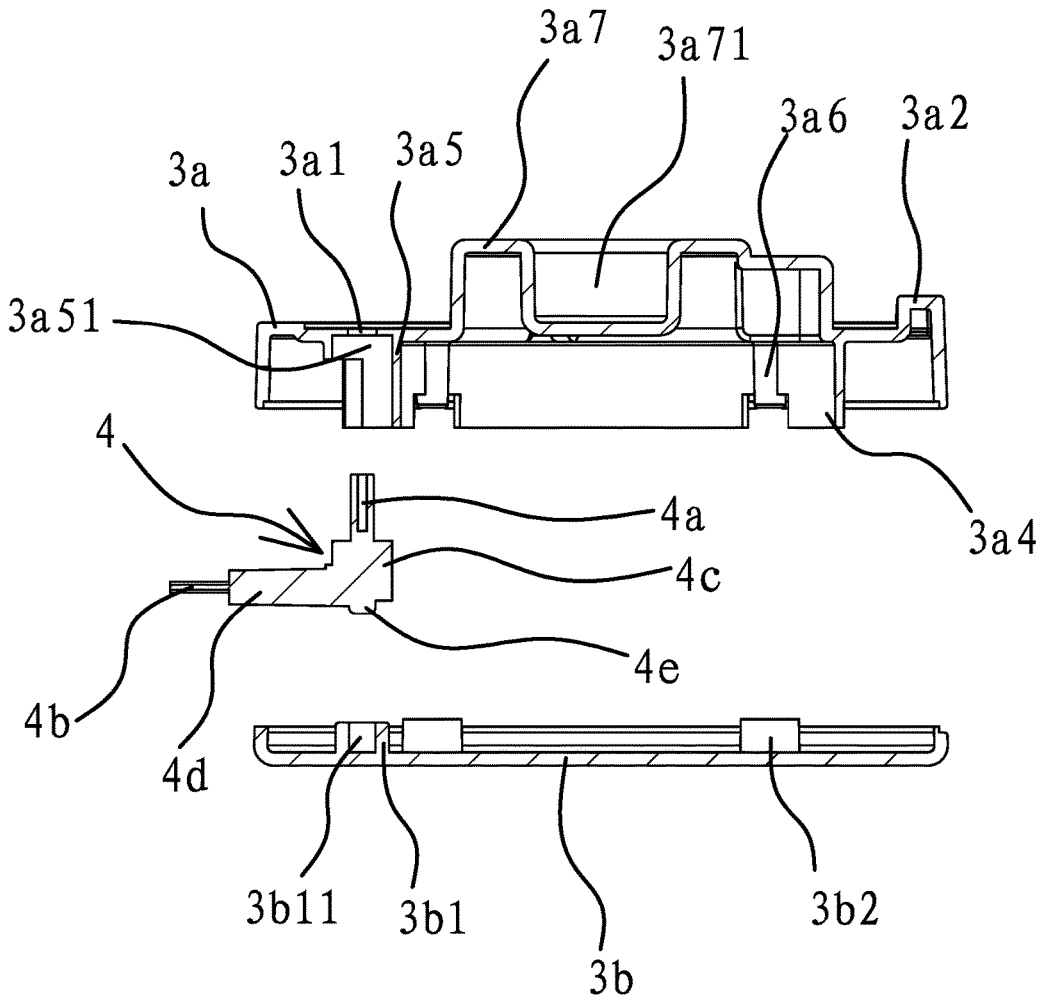
FIG. 9 is an exploded sectional view of the base of one embodiment of the present electric pencil sharpener.
Figure 10:
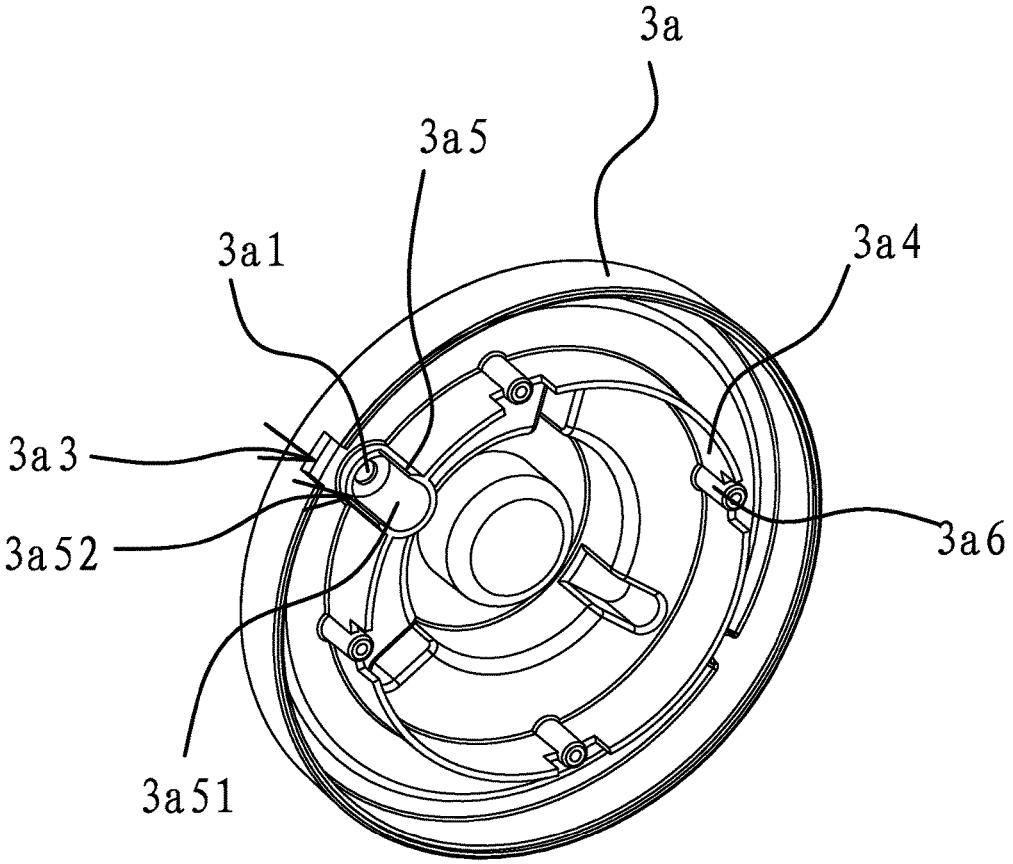
FIG. 10 is the schematic view of the base frame of the base of one embodiment of the present electric pencil sharpener.
Figure 11:
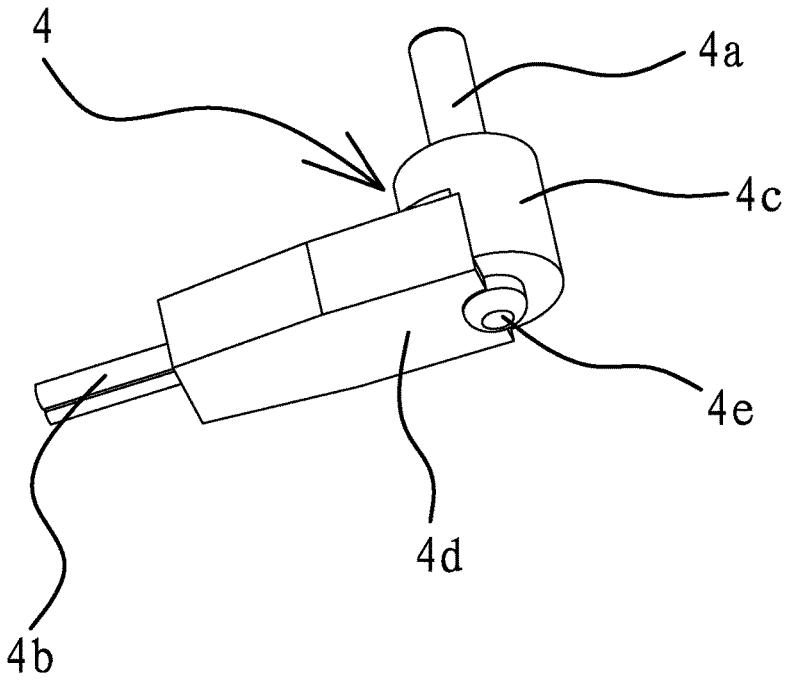
FIG. 11 is the schematic view of the power connector of one embodiment of the present electric pencil sharpener.

As shown in FIG. 9, FIG. 10, and FIG. 11, there are locating columns (3*a*5) on the annular collar (3*a*4), and there is a locating hole (3*a*51) on the locating column (3*a*5), arranged upward from the bottom of the locating column (3*a*5). There is a first notch (3*a*52) on the side of the locating column (3*a*5), and a second notch (3*a*3) is arranged through the side of the base frame (3*a*). An output hole (3*a*1) is arranged on the base frame (3*a*), and the output hole (3*a*1) is aligned to the locating hole (3*a*51). The power connector (4) has a columnar locator (4*c*), as well as a junction (4*d*) connected to the side of the locator (4*c*). The locator (4*c*) is located inside the locating column (3*a*5), and the junction (4*d*) consecutively passes through the first notch (3*a*52) and the second notch (3*a*3), and stretches out of the side of the base frame (3*a*). The output lead (4*a*) is located on the locator (4*c*) and the output lead (4*a*) sticks out from the output hole (3*a*1). The input lead (4*b*) is located on the junction (4*d*). The power connector (4) also has a bulge (4*e*), and the bulge (4*e*) is on the bottom of the locator (4*c*). There is a boss (3*b*1) on the base plate (3*b*). The boss (3*b*1) has a mating hole (3*b*11), and the bulge (4*e*) is embedded into the mating hole (3*b*11). Through the mating of the bulge (4*e*) and the boss (3*b*1), and the mating of the locator (4*c*) and the locating column (3*a*5), the axial fixation of the power connector (4) inside the base (3) is achieved. At the same time, the circumferential fixation of the power connector (4) is achieved by mating the junction (4*d*) with the first notch (3*a*52) and the second notch (3*a*3). Hence, a stable mate between the output lead (4*a*) and the power connector hole (1*c*1) is ensured when the housing (1) is placed on the base (3).

As shown in FIG. 4, FIG. 5, FIG. 6, and FIG. 7, a locating structure is arranged between the base (3) and the housing (1), which keeps the housing (1) positioned when the output lead (4*a*) plugs into the power connector hole (1*c*1). The locating structure comprises a locating bump (3*a*2) protruding along the rim of the upper surface of the base (3*a*), as well as a locating recess (1*d*) located on the housing (1). The upper surface of the locating bump (3*a*2) is a convex cambered surface, and the shape of the locating recess (1*d*) is the same as that of the locating bump (3*a*2). In this embodiment, the locating recess (1*d*) comprises a first recess (1*c*2) and a second recess (1*b*21). The first recess (1*c*2) is located on the pan (1*c*), and the second recess (1*b*21) is located on the lower shell (1*b*). The first recess (1*c*2) is connected to the second recess (1*b*21). When the housing (1) abuts on the base (3), the locating bump (3*a*2) is embedded into the first recess (1*c*2) and the second recess (1*b*21).

Figure 5:
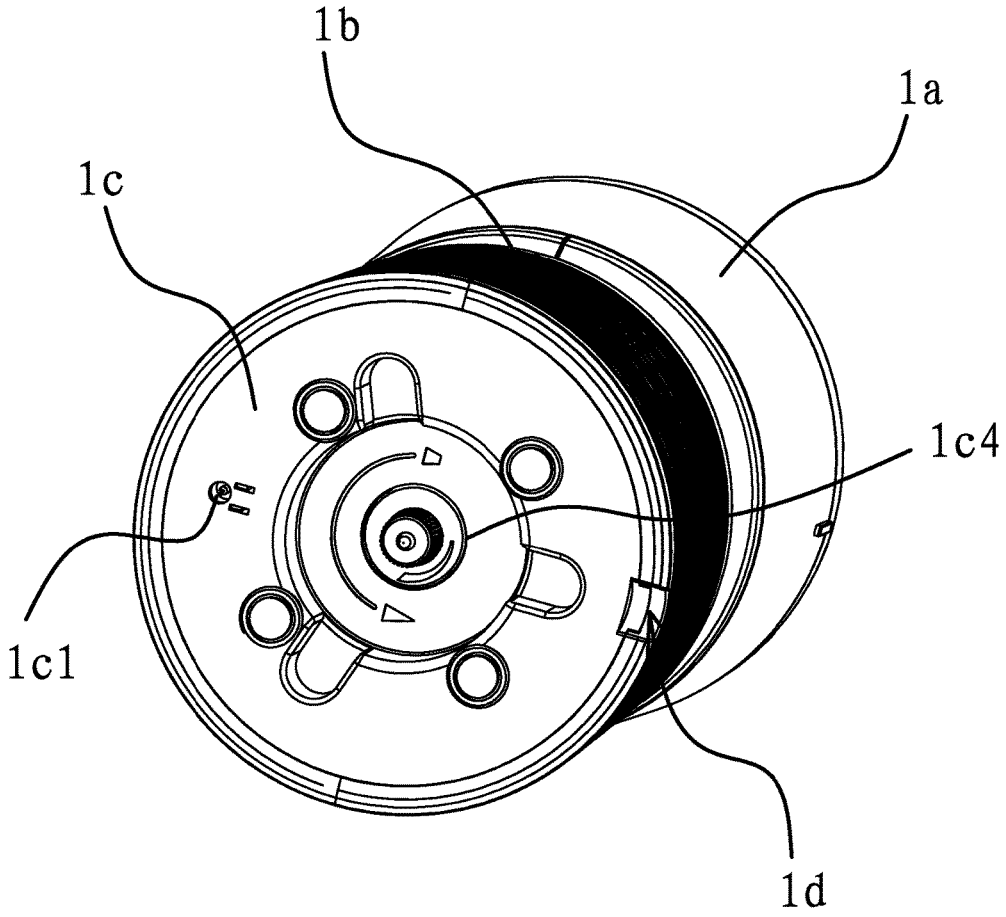
FIG. 5 is a schematic view of the housing of one embodiment of the present electric pencil sharpener.
Figure 6:
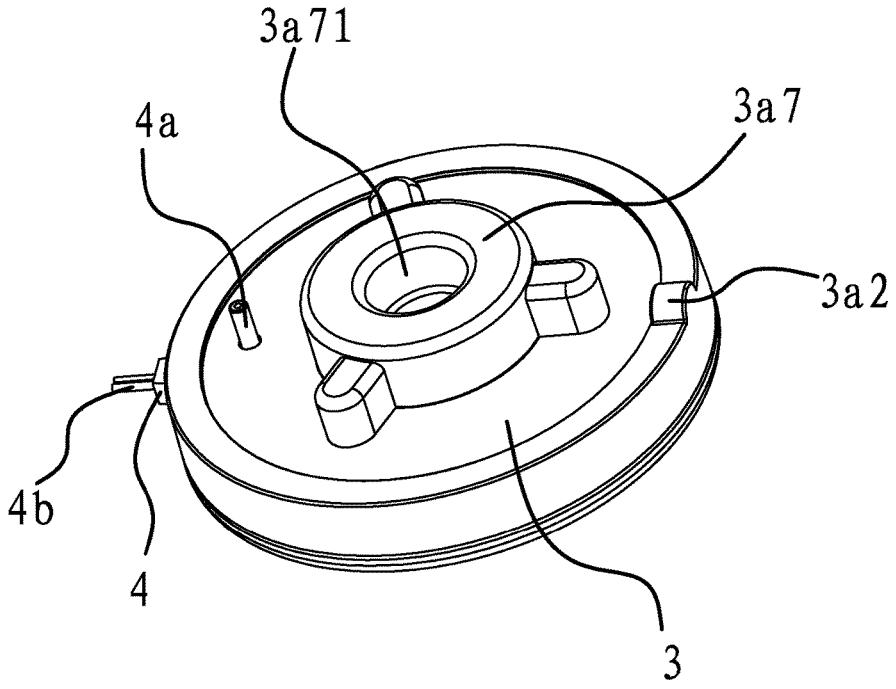
FIG. 6 is a schematic view of the base of one embodiment of the present electric pencil sharpener.
Figure 7:
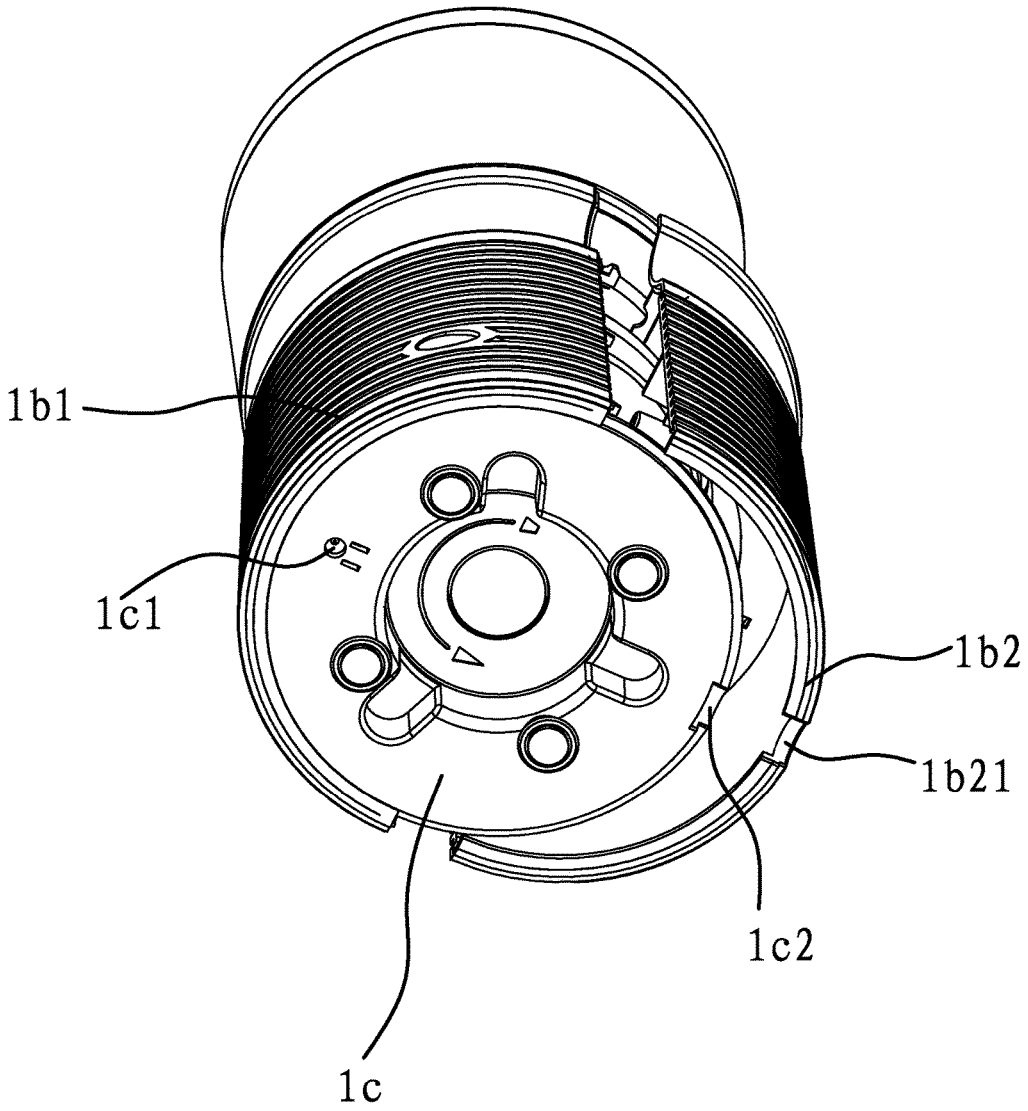
FIG. 7 is a schematic view of the housing of one embodiment of the present electric pencil sharpener while the lower shell is partially disassembled.
Figure 8:
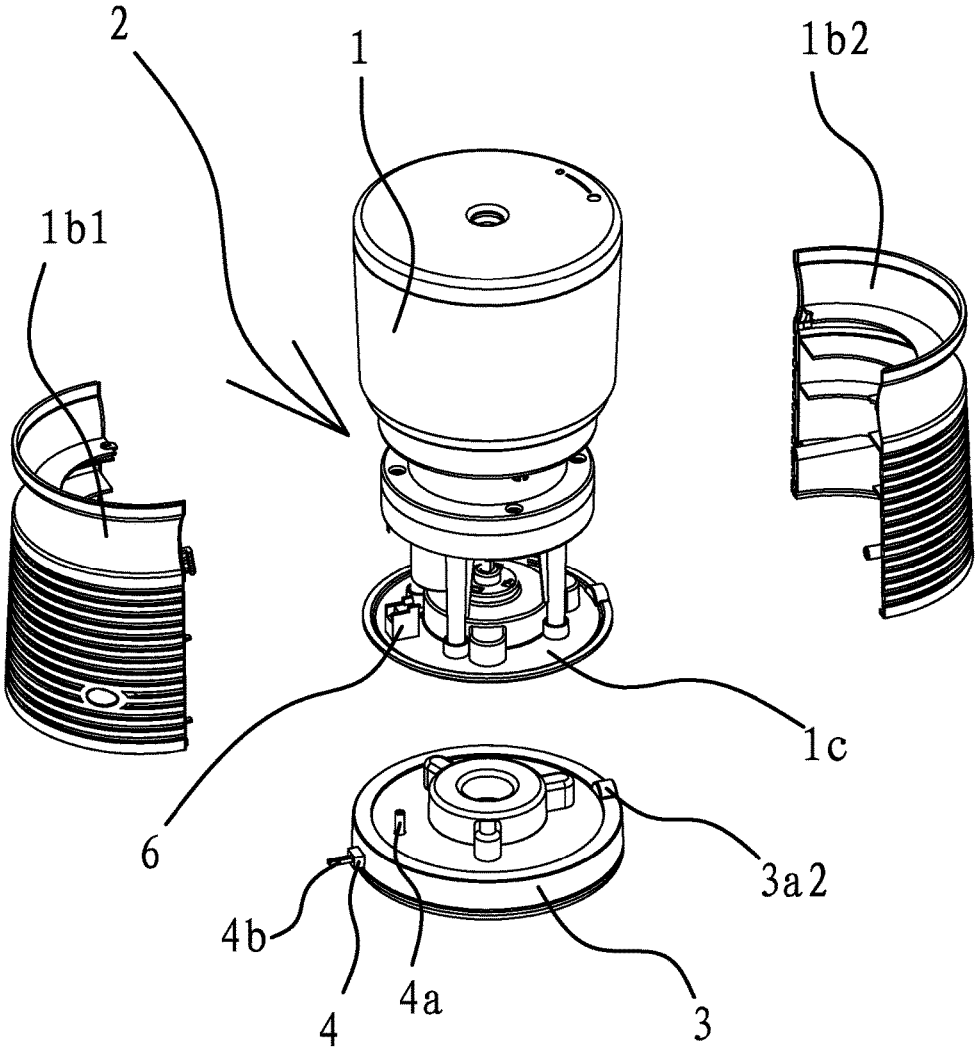
FIG. 8 is an exploded view of the housing of one embodiment of the present electric pencil sharpener.

As shown in FIG. 5 and FIG. 6, in this embodiment, an access cavity (1*c*4) is arranged at the bottom center of the pan (1*c*). There is a protruding embedding part (3*a*7) on the base frame (3*a*) of the base (3). The embedding part (3*a*7) has the same shape as that of the access cavity (1*c*4). The embedding part (3*a*7) is embedded into the access cavity (1*c*4), and a access hole (3*a*71) is arranged on the embedding part (3*a*7). To some extent, the mating between the access cavity (1*c*4) and the embedding part (3*a*7) can achieve locating of the pan (1*c*). Meanwhile, the adjusting rod inside the sharpener core (2) extends into the access cavity (1*c*4). In order to prevent the embedding part (3*a*7), while embedded in the access cavity (1*c*4), from interfering with the extension of the adjusting rod, the access hole (3*a*71) is arranged on the embedding part (3*a*7). Hence, the end of the adjusting rod is located inside the access hole (3*a*71), and the interference is avoided.

When the pencil needs to be sharpened, the housing (1) is placed on the base (3), and it is ensured that the output lead (4*a*) of the power connector (4) can be plugged into the power connector hole (1*c*1) and connected to the power receptacle (5). Then, the input lead (4*b*) of the power connector (4) is connected to the power source, making the electric power from the power source transmitted to the sharpener core (2) through the power connector (4). Hence the sharpener core (2) can sharpen the pencil. When sharpening is completed and the shavings debris needs to be emptied, the housing (1) may be directly pulled off the base (3), and then the housing (1) can be disassembled to empty the shavings debris. There is no need to switch off the power, mainly because the output lead (4*a*) of the power connector (4) automatically detaches from the power receptacle (5) after the housing (1) is pulled off the base (3). In addition, after the electrical connection is disconnected between the output lead (4*a*) of the power connector (4) and the power receptacle (5), even if the power source is not disconnected, the power source can no longer transmit electric power to the sharpener core (2), so as to achieve the function of automatic power down when emptying the shavings debris.

Separately, since the sharpener core (2) is driven by the motor to sharpen pencils, it is prone to vibrating the electric pencil sharpener when sharpening pencils. In addition, the housing (1) is placed on the base (3), and the base (3) is seated on the desktop and stays stationary. Hence, when sharpening pencils, the housing (1) will produce the shift in the radial and circumferential directions relative to the base (3). Since the output lead (4*a*) of the power connector (4) is plugged into the power connector hole (1*c*1), The radial and circumferential shifts of the housing (1) of the base (3) will act on the output lead (4*a*) of the power connector (4) through the power connector hole (1*c*1), making the output lead (4*a*) of the power connector (4) inclined or bended. Hence, the connection stability between the power connector (4) and the power receptacle (5) will be affected. As a result, after a long time of use, an accidental power down would arise because of the unstable connection between the power connector (4) and the power receptacle (5).

For the situation stated above, in one embodiment of the present electric pencil sharpener, a locating structure is formed between the housing (1) and the base (3) by arranging a locating bump (3*a*2) on the base (3), arranging a locating recess (1*d*) on the housing (1), and embedding the locating bump (3*a*2) into the locating recess (1*d*), so as to prevent the housing (1) from shifting in the radial and circumferential directions relative to the base (3) due to vibration and producing synchronous vibration between the housing (1) and the base (3). Hence, the stability of plugging the output lead (4*a*) of the power connector (4) into the power connector hole (1*c*1) is improved. Not only the automatic power down during shavings discharge is implemented, but accidental power outages, caused by the implementation of automatic power down, during pencil sharpening are also prevented, and the normal sharpening operation of the electric pencil sharpener is ensured.

Also, the locating recess (1*d*) comprises the first recess (1*c*2) and the second recess (1*b*21). The first recess (1*c*2) is located on the pan (1*c*), and the second recess (1*b*21) is located on the lower shell (1*b*). The pan (1*c*) is directly fixed to the sharpener core (2) and connected to the mouth of the lower shell (1*b*). The vibration of the sharpener core (2) first impacts the pan (1*c*), and then transmits to the lower shell (1*b*) through the pan (1*c*). Then, as the locating bump (3*a*2) is embedded into the first recess (1*c*2), the pan (1*c*) is circumferentially secured to the base (3), and hence the synchronous vibration between the pan (1*c*) and the base (3) is achieved. At the same time, the locating bump (3*a*2) is also embedded into the lower shell (1*b*21), making the lower shell (1*b*) circumferentially secured to the base (3) at the same time. Therefore, the base (3), the pan (1*c*) and the lower shell (1*b*) vibrate synchronously, preventing the whole body of the housing (1) from shifting in the radial and circumferential directions relative to the base (3). While the function of automatic power down when emptying the shavings debris is achieved by the added arrangement of the base (3), the impact from the vibration of the sharpener core (2) to the power connector (4) is greatly weakened, and the normal service performance of the electric pencil sharpener is ensured.

Second Embodiment

The structure and principle of this embodiment are basically the same as those of the first embodiment. The differences are:

In this embodiment, the locating structure comprises a connecting cavity arranged at the bottom center of the housing (1), as well as a mating part protruding from the top center of the base (3). The cross section of the mating part is not circular. The shape of the connecting cavity is the same as that of the mating part, and the mating part is embedded into the connecting cavity.

Using a locating structure, which consists of a mating part with a non-circular cross-section and a connecting cavity in the same shape as the mating part, can also prevent the housing (1) from shifting in the radial and circumferential directions relative to the base (3) due to vibrations. Therefore, this improves the poor connection stability between the power connector (4) and the power receptacle (5) resulting from achieving the automatic power down function when emptying the shavings debris.

The description of the preferred embodiments thereof serves only as an illustration of the spirit of the invention. It will be understood by those skilled in the art that various changes or supplements in form and details may be made therein without departing from the spirit and scope of the invention as defined by the appended claims.

LIST OF REFERENCE NUMERALS

1 Housing
1*a* Upper Shell
1*b* Lower Shell
1*b*1 Left Pod
1*b*11 Stopper
1*b*2 Right Pod
1*b*21 Second Recess
1*b*3 Annular Retainer
1*c* Pan
1*c*1 Power Connector Hole
1*c*2 First Recess
1*c*3 Annular Flange
1*c*4 Access Cavity
1*d* Locating Recess
2 Sharpener Core
21 Core Chassis
22 Pencil Bracket

23 Sharpening Component
24 Motor
25 Pencil Stopper Block
26 Mandrel
27 Gear Transmission Mechanism
3 Base
3*a* Base Frame
3*a*1 Output Hole
3*a*2 Locating Bump
3*a*3 Second Notch
3*a*4 Annular Collar
3*a*5 Locating Column
3*a*51 Locating Hole
3*a*52 First Notch
3*a*6 Mounting Post
3*a*7 Embedding Part
3*a*71 Access Hole
3*b* Base Plate
3*b*1 Boss
3*b*11 Mating Hole
3*b*2 Mounting Stand
4 Power Connector
4*a* Output Lead
4*b* Input Lead
4*c* Locator
4*d* Junction
4*e* Bulge
5 Power Receptacle
6 Clamping Block
6*a* Clamping Slot
6*b* Buckle

What is claimed is:

1. An electric pencil sharpener comprising:
a housing (1);
a base (3), the housing (1) placed on the base (3);
a power connector (4) fixed to the base (3);
a power receptacle (5) fixed to the housing (1), the power connector (4) electrically connected to the power receptacle (5); and
a locating structure arranged between the housing (1) and the base (3), the locating structure capable of circumferentially securing the housing (1) and the base (3).

2. The electric pencil sharpener of claim 1, further comprising:
a locating bump (3*a*2) of the locating structure, the locating bump (3*a*2) protruding from a rim of an upper surface of the base (3); and
a locating recess (1*d*) arranged on a bottom of the housing (1), the locating bump (3*a*2) being embedded into the locating recess (1*d*).

3. The electric pencil sharpener of claim 2, further comprising:
a pan (1*c*) of the housing (1);
a lower shell (1*b*) of the housing (1);
a mouth on a lower end of the lower shell (1*b*), the pan (1*c*) connected to the lower end of the lower shell (1*b*) and seals the mouth of the lower shell (1*b*);
a sharpener core (2) arranged inside the housing (1), the sharpener core (2) fixed to the pan (1*c*);
a first recess (1*c*2) of the locating recesses (1*d*), the first recess (1*c*2) arranged on a bottom of the pan (1*c*); and
a second recess (1*b*21) of the locating recesses (1*d*), the second recess (1*b*21) arranged on a bottom of the lower shell (1*b*);
wherein the first recess (1*c*2) is connected to the second recess (1*b*21); and
wherein the locating bump (3*a*2) is embedded into both the first recess (1*c*2) and the second recess (1*b*21).

4. The electric pencil sharpener of claim 3, further comprising:
a left pod (1*b*1) of the lower shell (1*b*), the left pod (1*b*1) having an arc plate shape;
a right pod (1*b*2) of the lower shell (1*b*), the right pod (1*b*2) having an arc plate shape, the left pod (1*b*1) and the right pod (1*b*2) fixed through fasteners;
an annular retainer (1*b*3) on an inner side of a lower end of the lower shell (1*b*); and
an annular flange (1*c*3) on an outer rim of the pan (1*c*);
wherein a lower end face of the annular flange (1*c*3) abuts on an upper end face of the annular retainer (1*b*3).

5. The electric pencil sharpener of claims 2
wherein an upper surface of the locating bump (3*a*2) is a convex cambered surface.

6. The electric pencil sharpener as claimed in claim 1, further comprising:
an access cavity (1*c*4) arranged at a bottom center of the housing (1); and
a embedding part (3*a*7) protruding from the top center of the base (3), a cross section of the embedding part (3*a*7) being not round;
wherein a shape of the connecting cavity is same as a shape of the embedding part (3*a*7); and
wherein the embedding part (3*a*7) is embedded into the connecting cavity.

7. The electric pencil sharpener of claim 1, further comprising:
a clamping block (6) fixed inside the housing (1);
a clamping slot (6*a*) set up downward on an upper end of the clamping block (6); and
a power connector hole (1*c*1) arranged on a bottom of the housing (1), the clamping slot (6*a*) aligned to the power connector hole (1*c*1);
wherein the power receptacle (5) is located inside the clamping slot (6*a*);
wherein an inner wall of the housing (1) has a stopper (1*b*11); and
wherein the stopper (1*b*11) abuts on an upper end of the power receptacle (5).

8. The electric pencil sharpener of claim 1, further comprising:
a locating column (3*a*5) inside the base (3);
a boss (3*b*1) inside the base (3), the boss (3*b*1) having a mating hole (3*b*11);
a locating hole (3*a*51) arranged on a bottom of the locating column (3*a*5);
an output hole (3*a*1) arranged on an upper face of the base (3), the output hole (3*a*1) aligned to the locating hole (3*a*51);
a columnar locator (4*c*) of the power connector (4), the locator (4*c*) located inside the locating hole (3*a*51);
an output lead (4*a*) arranged on the locator (4*c*), the output lead (4*a*) passes through the output hole (3*a*1) and connects the power receptacle (5); and
a bulge (4*e*) on a bottom of the locator (4*c*), the bulge (4*e*) being embedded into the mating hole (3*b*11).

9. The electric pencil sharpener of claim 8, further comprising:
a first notch (3*a*52) on a side of the locating column (3*a*5);
a second notch (3*a*3) on a side of the base (3);
a junction (4*d*) of the power connector (4), the junction (4*d*) connected to a side of the locator (4*c*); and an input lead (4*b*) of the power connector (4), the input lead (4*b*) located on a side of the junction (4*d*), the input lead (4*b*) located outside of a side wall of the base (3);

wherein the junction (4*d*) consecutively passes through the first notch (3*a*52) and then the second notch (3*a*3);

wherein the junction (4*d*) stretches out of a side of the base (3); and wherein a side wall of the junction (4*d*) abuts a side wall of the first notch (3*a*52) and a side wall of the second notch (3*a*3).

10. The electric pencil sharpener of claim 6, wherein a locating bump (3*a*2) and the power connector (4) arranged on the same diameter direction are both lower than the embedding part (3*a*7).

11. The electric pencil sharpener of claim 1, further comprising:

a sharpener core (2) arranged inside the housing (1);

a core chassis (21) of the sharpener core (2), the core chassis (21) having an upper end opening;

a pencil bracket (22) set inside the core chassis (21);

a sharpening component (23) on one side of the pencil bracket (22); and a motor (24) fixed at an eccentric position of the core chassis (21), the motor (24) drives the sharpening component (23) through a gear transmission mechanism (27).

12. The electric pencil sharpener of claim 6, further comprising:

a clamping block (6) fixed inside the housing (1) beside the connecting cavity;

a clamping slot (6*a*) set up downward on an upper end of the clamping block (6); and a power connector hole (1*c*1) arranged on a bottom of the housing (1), the clamping slot (6*a*) aligned to the power connector hole (1*c*1);

wherein the power receptacle (5) is located inside the clamping slot (6*a*);

wherein an inner wall of the housing (1) has a stopper (1*b*11); and wherein the stopper (1*b*11) abuts on an upper end of the power receptacle (5).

13. The electric pencil sharpener of claim 7, further comprising:

a locating column (3*a*5) inside the base (3) beside a mating part;

a boss (3*b*1) inside the base (3), the boss (3*b*1) having a mating hole (3*b*11);

a locating hole (3*a*51) arranged on a bottom of the locating column (3*a*5);

an output hole (3*a*1) arranged on an upper face of the base (3), the output hole (3*a*1) aligned to the locating hole (3*a*51);

a columnar locator (4*c*) of the power connector (4), the locator (4*c*) located inside the locating hole (3*a*51);

an output lead (4*a*) arranged on the locator (4*c*), the output lead (4*a*) passes through the output hole (3*a*1) and connects the power receptacle (5); and a bulge (4*e*) on a bottom of the locator (4*c*), the bulge (4*e*) being embedded into the mating hole (3*b*11).

14. The electric pencil sharpener of claim 12, further comprising:

a locating column (3*a*5) inside the base (3) beside a mating part;

a boss (3*b*1) inside the base (3), the boss (3*b*1) having a mating hole (3*b*11);

a locating hole (3*a*51) arranged on a bottom of the locating column (3*a*5);

an output hole (3*a*1) arranged on an upper face of the base (3), the output hole (3*a*1) aligned to the locating hole (3*a*51);

a columnar locator (4*c*) of the power connector (4), the locator (4*c*) located inside the locating hole (3*a*51);

an output lead (4*a*) arranged on the locator (4*c*), the output lead (4*a*) passes through the output hole (3*a*1) and connects the power receptacle (5); and a bulge (4*e*) on a bottom of the locator (4*c*), the bulge (4*e*) being embedded into the mating hole (3*b*11).

* * * * *